US006007306A

United States Patent [19]

Vilagines

[11] Patent Number: 6,007,306

[45] Date of Patent: Dec. 28, 1999

[54] MULTIPHASE PUMPING SYSTEM WITH FEEDBACK LOOP

[75] Inventor: Regis Vilagines, Vernaison, France

[73] Assignee: Institute Francais du Petrole, Rueil-Malmaison, France

[21] Appl. No.: 08/891,991

[22] Filed: Jul. 14, 1997

Related U.S. Application Data

[63] Continuation of application No. 08/527,899, Sep. 14, 1995, abandoned.

[30] Foreign Application Priority Data

Sep. 14, 1994 [FR] France ..... 9411048

[51] Int. Cl.[6] ..... F04B 49/00; F04B 23/08

[52] U.S. Cl. ..... 417/307; 417/87

[58] Field of Search ..... 417/77, 79, 80, 417/87, 90, 307

[56] References Cited

U.S. PATENT DOCUMENTS

| | | | |
|---|---|---|---|
| 2,080,624 | 5/1937 | McMahon | 417/79 |
| 2,651,259 | 9/1953 | Brush | 417/77 X |
| 3,490,376 | 1/1970 | Valdespino | 417/77 |
| 3,736,072 | 5/1973 | Turner et al. | 417/79 |
| 4,373,864 | 2/1983 | Massey et al. | 417/307 |
| 4,894,069 | 1/1990 | Arnaudeau . | |
| 5,375,976 | 12/1994 | Arnaudeau | 415/199.5 |
| 5,393,202 | 2/1995 | Levallois | 417/19 |

*Primary Examiner*—Timothy Thorpe
*Assistant Examiner*—Cheryl J. Tyler
*Attorney, Agent, or Firm*—Antonelli, Terry, Stout & Kraus, LLP

[57] ABSTRACT

The invention relates to a pumping system for applying a sufficient pressure increase to multiphase effluents for them to be conveyed from a source such as an petroleum producing well to a remote destination point. To improve pump function and render management of effluent transfers more flexible, the system has a loop (7) for recycling a fraction of the multiphase effluents leaving pump (1) to the inlet thereof, comprising preferably a tap (5) such as a T formed to decrease the volumetric ratio GLR of the recycled effluents. A regulator such as a control valve (8) and a buffer tank and an element (9) such as an ejector-mixer are interposed in the loop to use part of the energy of the effluents tapped off. The invention has application for offshore pumping facilities.

28 Claims, 5 Drawing Sheets

MULTIPHASE PUMPING SYSTEM WITH FEEDBACK LOOP

This application is a Continuation application of application Ser. No. 08/527,899, filed Sep. 14, 1995, now abandoned.

BACKGROUND OF THE INVENTION

1. Field of the Invention

The present invention relates to a multiphase pumping system with a recycling loop.

The pumping system according to the invention is suitable for carrying, via pipes, a fluid comprised of at least one liquid phase and at least one gaseous phase, whose gas phase to liquid phase volumetric ratio (generally designated GLR) can vary widely.

Such a pumping system has applications particularly in the field of oil production for transporting, to a given destination point, petroleum effluents from an underground deposit, and particularly for working offshore deposits.

2. Description of the Prior Art

Existing multiphase pumping systems have a multiphase pump such as for example that described in U.S. Pat. No. 5,375,296 filed by the Assignee capable of applying a high pressure to a multiphase fluid provided the GLR volume ratio does not exceed a certain maximum value. When the GLR of the fluid to be transported exceeds this maximum value, as occurs in oil production when the fluid produced by a producing well has air pockets or plugs, a regulator is associated with the pump. These regulators are designed to limit the possible range of variation of the GLR to make it compatible with that accepted by the pump.

A known regulator, as described for example in U.S. Pat. No. 5,393,202 has for example a buffer tank receiving fluids produced by the deposit and having one or more perforated sampling tubes capable of automatically adjusting the phase ratio admitted at the pump inlet.

Such an arrangement gives satisfactory results but has the drawback of being bulky and relatively expensive.

U.S. Pat. No. 4,894,069 teaches a pumping system with a regulating loop. The pump outlet is connected to a phase separation device designed to extract multiphase fluid having a fraction composed almost completely of liquid. This liquid fraction is recycled by a branch line to the pump inlet where it reduces the value of the GLR ratio when it becomes excessive.

SUMMARY OF THE INVENTION

The pumping system with recycling loop according to the invention applies, to multiphase effluents from one source having at least one liquid phase and at least one gas phase and whose GLR volumetric ratio of the gas phases to the liquid phases can vary, a pressure increase sufficient for them to be conveyed to a given destination point. The pumping system has a multiphase pump and a recycling loop and is characterized by having in combination a tapping device for tapping directly, via the recycling loop, part of the multiphase fluid available at the pump outlet and sending it to the pump inlet and monitor for monitoring the multiphase fluid tapped in the loop in order to decrease the flow of fluid carried by the line and increase the possible operating speed of said pump.

According to a preferred embodiment, the tapping device is an element designed to distribute the liquid phases of the multiphase effluents which are fed more to a first outlet than to a second outlet (for example T-shaped or Y-shaped outlets), the first outlet, having more liquid phase, is connected to the recycling loop in order to decrease to some degree the GLR ratio of the multiphase fluid recycled at the pump inlet and facilitate the operation of the pump.

The monitor may comprise for example a valve, a buffer tank, or an element using part of the energy of the tapped multiphase effluents.

The pumping system can also include an assembly for controlling the monitor to perform regulation as a function of the pumping conditions.

The pumping system according to the invention, by partial recycling of some of the multiphase effluents coming from a pump, enables the latter better to deal with the effluents whose volumetric ratio GLR is relatively high. Because of the regulation possibilities of recycling, it offers greater flexibility when carrying out processing upstream or downstream. Moreover, its implementation does not require no relatively bulky and expensive phase separator.

BRIEF DESCRIPTION OF THE DRAWINGS

Other characteristics and advantages of the system according to the invention will appear more clearly on reading the description hereinbelow of embodiments described as nonlimiting examples with reference to the attached drawings wherein.

DESCRIPTION OF THE PREFERRED EMBODIMENT

Figure 1:
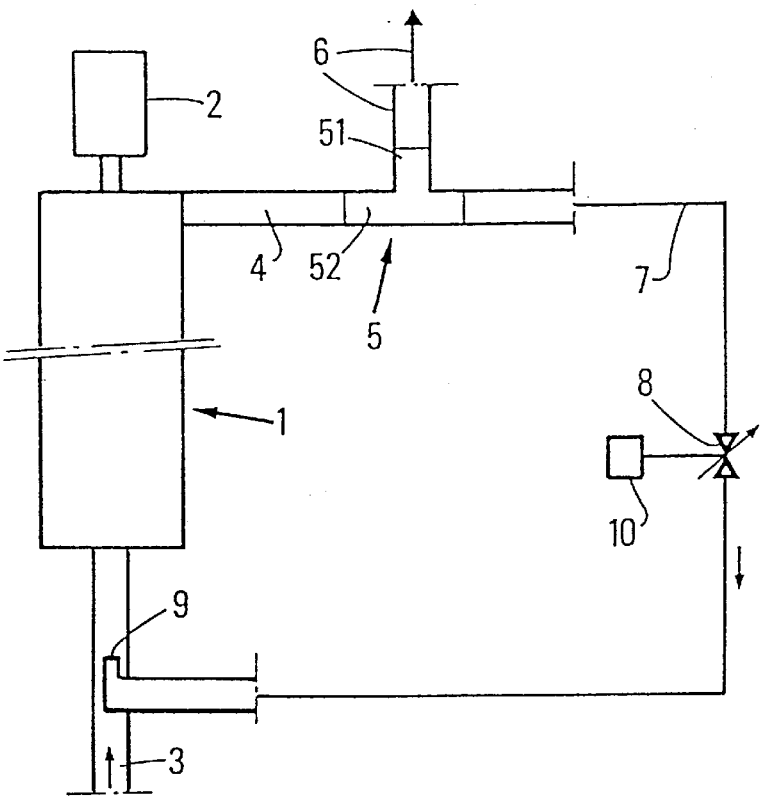
FIG. 1 shows schematically one embodiment of the pumping system of the invention.

The pumping system according to the invention has a multiphase pump 1 of a known type such as the pump described in the aforementioned U.S. Pat. No. 5,375,926, associated with a drive motor 2. The inlet of pump 1 is connected by a line 3 to a source of multiphase fluids. This source is for example an oil production well which produces liquid effluents: oil and water, and gaseous effluents. Pump 1 is designed to apply to the effluents an increase in pressure $\Delta P$ sufficient to bring them to a destination point as long as the volumetric gas-to-liquid ratio or GLR is kept within a certain variation range. A tapping element 5 allowing the multiphase flow coming from pump 1 to be divided into two parts is inserted into line 4 leaving pump 1. Preferably, a T-shaped connector of a known type is used and its right-angled branch 51 is connected to a line 6 for bringing the effluents to the destination point. Straight section 52 of the T is connected at a first end to line 4. A recycling circuit or loop 7 provided with a control valve 8 is connected at a first end to straight section 52 of the T and at its opposite end to the inlet line to the pump via a mixing element 9 of known type such as an ejector-mixer which allows some of the energy of the recycled effluents to be used to favor their mixing with those coming from line 3, for example of the type described in Swiss Patent 680,463. Control valve 8 is operated by a processor 10 designed to modify the recycled flow according to variations in pumping conditions.

It is known, particularly from an article by G. E. McCrery et al. in Int. J. Multiphase Flow Vol. 16, No. 3, pp. 429–445 that a T-shaped or Y-shaped divider divides a flow applied thereto unequally and that the GLR ratio of the fraction tapped by straight section 52 is reduced.

Under these conditions, the use of such a splitting element has the effect of decreasing the GLR ratio of the multiphase effluents recycled by the recycling circuit 7 and hence of reducing the GLR ratio of the effluents entering pump 1 as well. As a result, a particularly useful improvement in pump function occurs when the GLR ratio of the effluents produced by the well is high. As can be seen when comparing the diagrams of FIGS. 3 and 4, such multiphase recycling very substantially improves and maintains pumping conditions.

Figure 3:
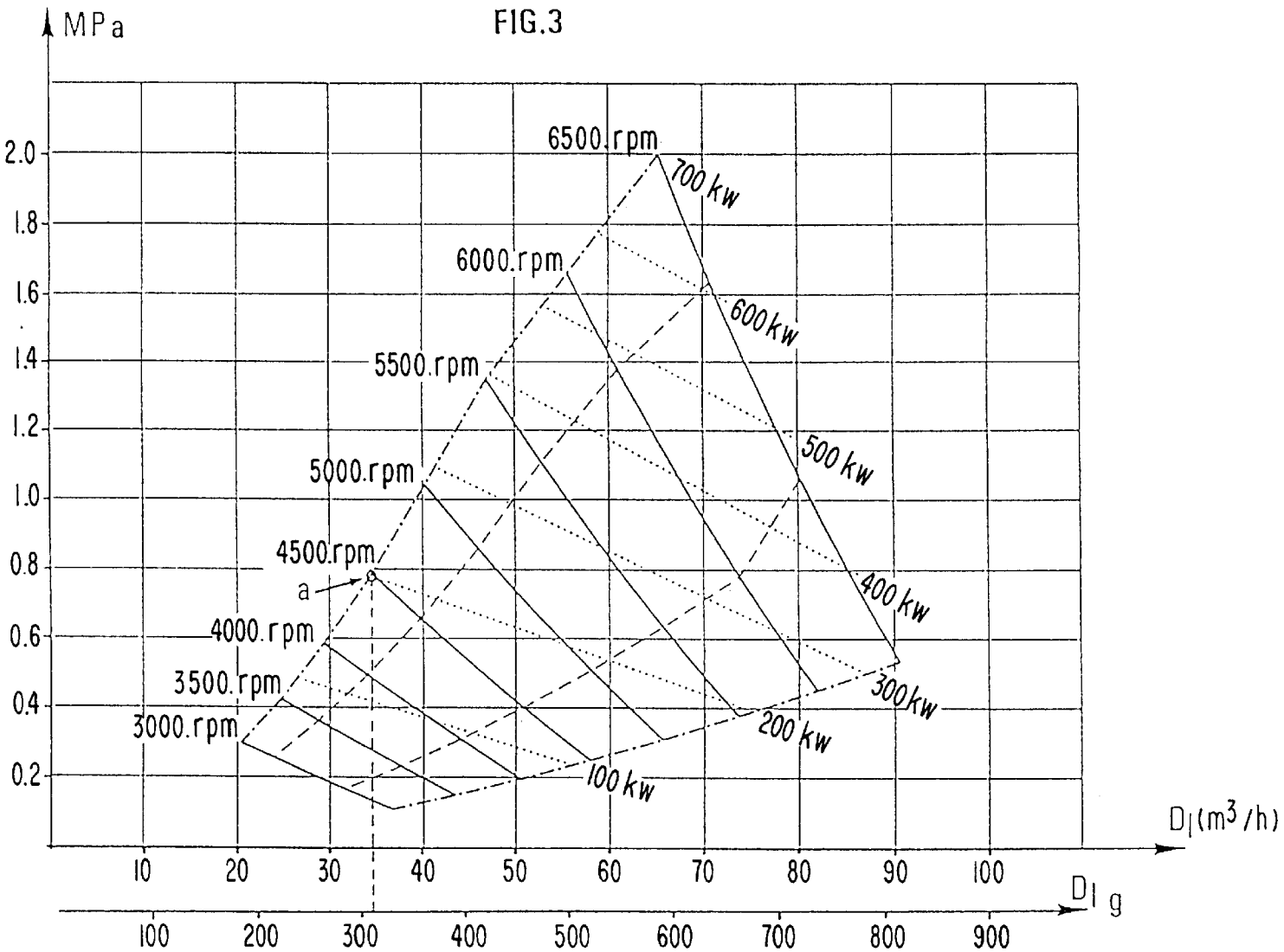
FIG. 3 shows a first operating diagram of a pump of the invention in the absence of recycling.

The diagram in FIG. 3 corresponds to that of a Poseidon Type P 300 multiphase screw pump, for example that described in the aforementioned U.S. Pat. No. 5,375,296 in the absence of any recycling. It shows the range of possible variation of the rise in pressure ΔP (in MPa) produced by the pump as a function of flowrate D to the intake for various rotational speeds. The intake pressure is 1.5 MPa. The volumetric GLR ratio of the effluents drawn in is 8. It can be seen that (point a) a pressure increase ΔP of 0.8 MPa is obtained at a speed of approximately 4500 rpm for a multiphase flowrate on the order of 310 $m^3/h$, and that for such a flowrate the available remaining pressure increase margin would be practically zero.

Figure 4:
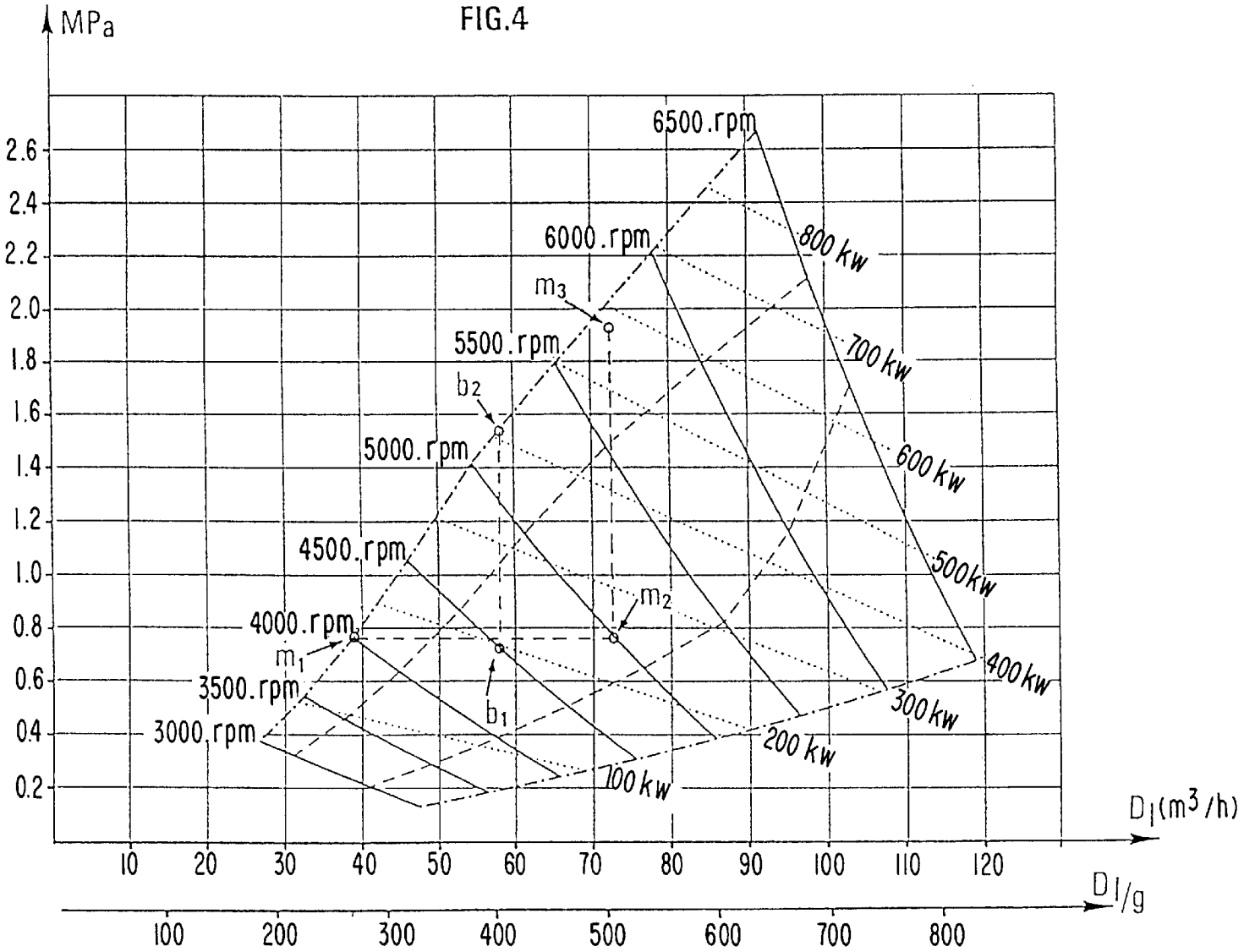
FIG. 4 shows in a diagram similar to FIG. 4 the effect of multiphase recycling on the operation of the foregoing pump of the invention.

The diagram of FIG. 4 shows that direct recycling of some of the effluents delivered by the pump, for a pressure increase ΔP of 0.75 MPa, allows its hourly throughput to be increased to 400 $m^3/h$ at a rotational speed of 4500 rpm (point b1) and at the same time the pressure increase ΔP that the pump can apply to the effluents drawn in if its drive speed is increased, to be expanded considerably. It can be seen that this pressure increase, in the case in point, can reach approximately 1.55 MPa at a rotational speed of 5200 rpm. The use of a branching divider 5 capable by design of sending to the recycling circuit a multiphase fraction whose GLR ratio is low, in the case illustrated by the diagram of FIG. 4, decreases the value of the GLR ratio of the aspirated effluents to 6.

With the pump indicated above in a case where the intake pressure is 1.5 MPa and the GLR ratio of the effluents from the source is 8, a calculation was made of the GLR value of this same ratio at the pump inlet taking into account recycling varying according to the proportion of gas in the recycled effluents. With l and g designating the proportions of recycled liquid and recycled gas, respectively, the following comparative table was established:

| | | |
|---|---|---|
| 1 = 0.2 | g = 0 | GLR = 6.4 |
| | g = 0.1 | GLR = 7.11 |
| 1 = 0.3 | g = 0 | GLR = 5.6 |
| | g = 0.15 | GLR = 6.59 |

-continued

| | | |
|---|---|---|
| 1 = 0.4 | g = 0 | GLR = 4.8 |
| | g = 0.2 | GLR = 6 |

Figure 5:
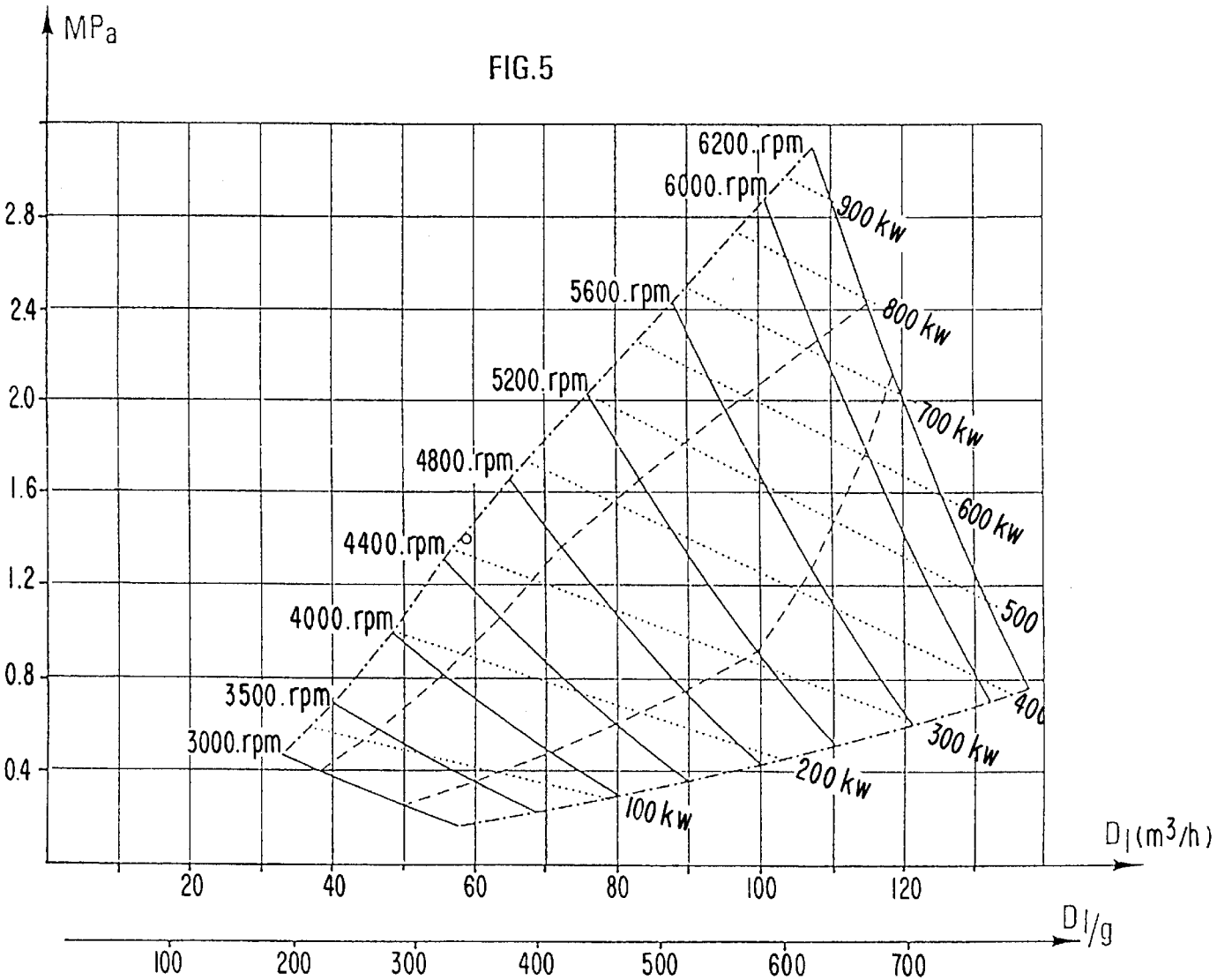
FIG. 5 shows an operating diagram of a pump where only a liquid phase is recycled.

In the examples above, the value g=0 corresponds to the case where there is a separator downstream of the pump to take up practically all the gas from the recycled effluents, as described in the aforementioned U.S. Pat. No. 4,894,069. From these examples it can be seen that, by carrying out direct multiphase recycling and using simply a T-shaped tapping device 5, which for example has selective partial separation properties, a decrease in the GLR ratio is obtained which, although slightly smaller, is of the same order of magnitude as would have been obtained by interposing a relatively bulky and expensive classical separator. What is more, it can be seen by comparing FIGS. 4 and 5 that the pressure gain rendered possible in the case of multiphase recycling and that of purely liquid recycling are entirely equivalent.

Processor 10 is used to control the opening of valve 8 as a function of the values of coefficients a, b1, and total flowrate Q of the well for example wherein coefficient a represents point a of FIG. 3 and coefficient b1 represents point b1 of FIG. 4.

In practice it is seen that the increase in pressure ΔP that the pump is capable of applying due to displacement of its operating point has little effect on the pressure of the effluents in flow circuit 6 downstream of the pump. As a result, there is a correlative decrease in intake pressure Pa, which has the general effect of increasing the flowrate of the source.

Installation of this recycling loop, as we have seen, makes it possible to increase the range of variation of the GLR ratio of the effluents that a multiphase pump can accept, and hence to extend the margin of possible variation of the pressure increase ΔP communicated by the pump. It may also be noted that the presence of this recycling loop and the regulating valve 8 also contributes to conferring great flexibility on the pumping system. Reinjection under pressure of the recycled fluid contributes to homogenizing the effluents at the inlet to pump 1. Recycling of a fraction of the effluents allows the pump to operate properly even with low-flowrate sources, which is particularly advantageous in oil production when the wells are becoming exhausted. The variation in recycling rate obtained by operating valve 8 allows startup and pump operation to be rendered more gradual particularly when there is an unwanted shutdown of the well upstream or the valves downstream. The presence of the loop broadens the options available to the operators who, without recycling, can only manipulate the pump drive speed.

Figure 2:
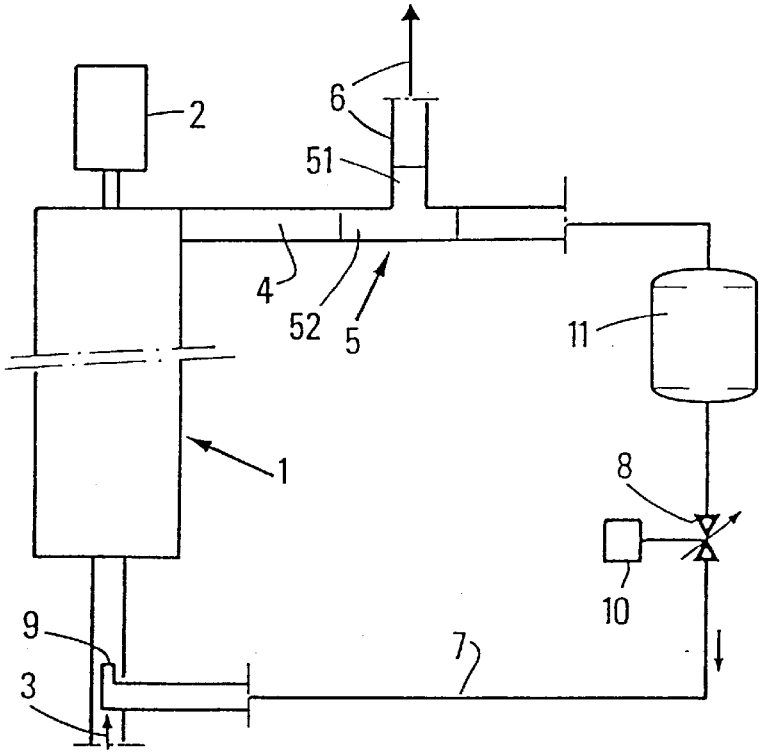
FIG. 2 shows schematically a variant of the above embodiment of the invention.
Figure 6:
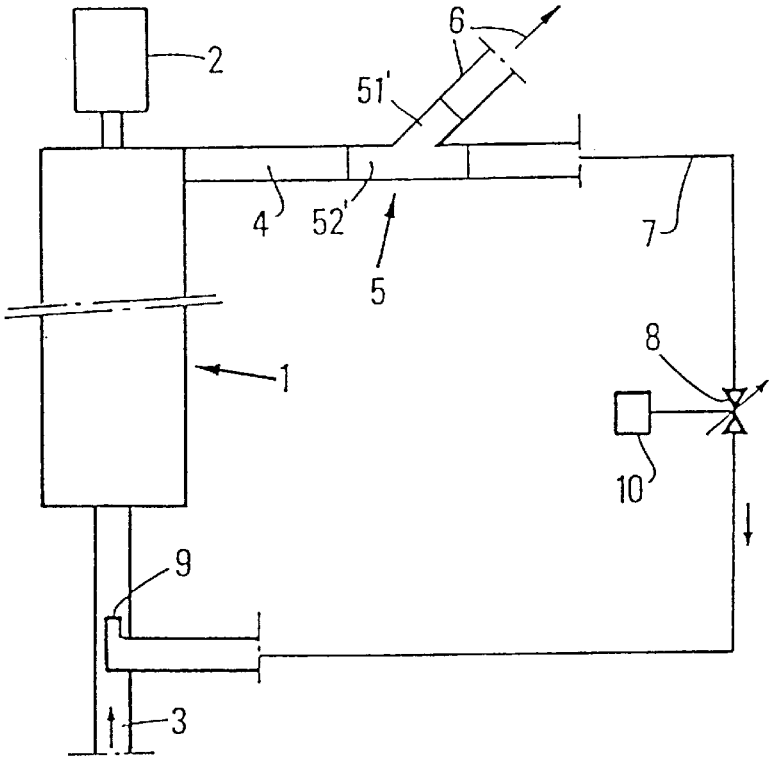
FIG. 6 is another embodiment of the pumping system which differs from FIG. 1 having a Y-shaped connector in place of a T-shaped connector.
Figure 7:
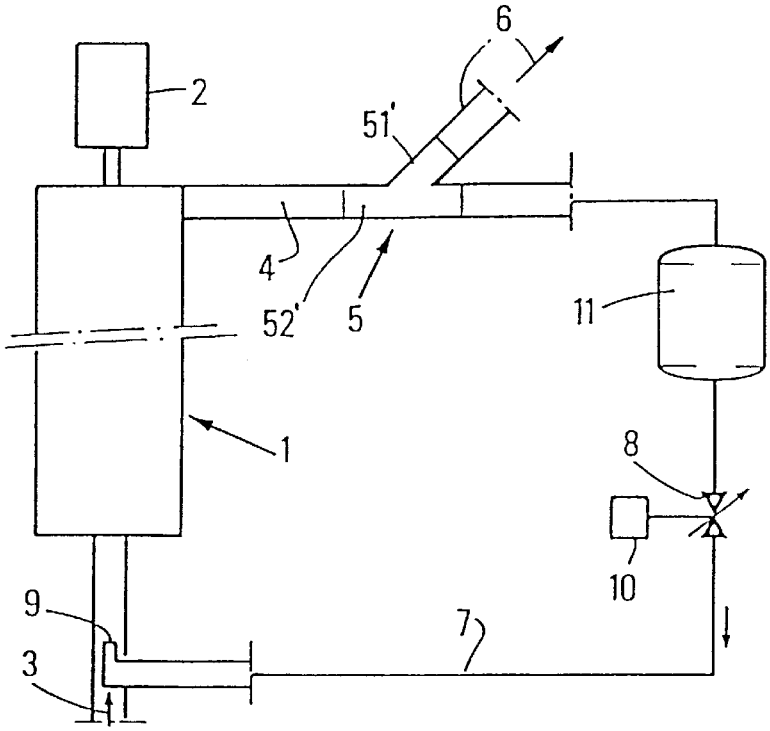
FIG. 7 is another embodiment of the pumping system which differs from FIG. 2 in having a Y-shaped connector in place of T-shaped connector.

FIGS. 6 and 7 illustrate two additional embodiments of the pumping system of the present invention which differ respectively from the embodiment of the pumping system of FIGS. 1 and 2 only in having a Y-shaped connector instead of a T-shaped connector. The angled branch 51' is connected to a line 6 for transporting the effluents to the destination point and the straight section 52' is connected to line 4 and the recycling circuit 7.

In the embodiment described, the recycling loop has only one interposed regulating valve. It would not however be a departure from the invention to interpose a buffer tank 11 as well (FIG. 2) to increase the options for regulating recycling. It is also possible to interpose a device such as an annular ejector able to reuse some of the energy of the recycled fluid and inject it upstream of the pump.

To tap multiphase effluents, it is preferable to use a tapping device with a phase-separation capability in order to reduce the volumetric GLR ratio of the recycled effluents. It would however not be a departure from the invention to replace this particular device by a nonselective connector. In this case, one would benefit from the greater operating flexibility offered by adjusting the recycled fraction. As shown in FIG. 4 an operating point $m_1$ is displaced to $m_2$ by recycling and then to $m_3$ by an increase in the drive speed of the pump.

I claim:

1. A pumping system which pumps a multiphase fluid including at least one liquid phase and at least one gas phase, having a variable volumetric GLR of the at least one gas phase to the at least one liquid phase, from a fluid source with a pressure increase through a line to a destination point, comprising:

a multiphase pump provided with an input and an output which pumps the multiphase fluid with a variable GLR;

a passive splitting device provided with an inlet connected with the output of the multiphase pump, a first outlet and a second outlet connected with the line, the splitting element distributing the liquid phase of the multiphase fluid applied thereto in greater amount to the first outlet than to the second outlet;

a recycling branch with a first end connected with the first outlet of the splitting device and a second end connected with the input of the multiphase pump; and a flow rate control coupled to the recycling branch for controlling fluid flow in the recycling branch; and wherein the splitting device and the recycling branch deliver to the input of the multiphase pump a multiphase fluid portion with a decreased GLR and the GLR of the output of the multiphase pump is not modified between the output of the multiphase pump and the input of the splitting device.

2. A pumping system according to claim 1, wherein:

the flow rate control includes a valve.

3. A pumping system according to claim 2, wherein:

the flow rate control includes a nozzle associated with the second end of the recycling branch.

4. A pumping system according to claim 2, wherein:

the flow rate control includes a regulator for regulating a recycled multiphase fluid portion depending on fluids provided from the fluid source.

5. A pumping system according to claim 2, wherein:

the splitting device is a T-shaped connector.

6. A pumping system according to claim 2, wherein:

the splitting device is a Y-shaped connector.

7. A pumping system according to claim 1, wherein:

the flow rate control comprises a buffer tank interposed in the recycling branch.

8. A pumping system according to claim 7, wherein:

the flow rate control includes a nozzle associated with the second end of the recycling branch.

9. A pumping system according to claim 7, wherein:

the flow rate control includes a regulator for regulating a recycled multiphase fluid portion depending on fluids provided from the fluid source.

10. A pumping system according to claim 7, wherein:

the splitting device is a T-shaped connector.

11. A pumping system according to claim 7, wherein:

the splitting device is a Y-shaped connector.

12. A pumping system according to claim 1, wherein:

the flow rate control includes a nozzle associated with the second end of the recycling branch.

13. A pumping system according to claim 1, wherein:

the flow rate control includes a regulator for regulating a recycled multiphase fluid portion depending on fluids provided from the fluid source.

14. A pumping system according to claim 1, wherein:

the splitting device is a T-shaped connector.

15. A pumping system according to claim 1, wherein:

the splitting device is a Y-shaped connector.

16. A pumping system which pumps a multiphase fluid including at least one liquid phase and at least one gas phase, having a variable volumetric GLR of the at least one gas phase to the at least one liquid phase, from a fluid source with a pressure increase through a line to a destination point, comprising:

means, provided with an input and an output, for pumping the multiphase fluid with a variable GLR;

a splitting device provided with an inlet connected with the output of the multiphase pump, a first outlet and a second outlet connected with the line, the splitting device distributing the liquid phase of the multiphase fluid applied thereto in greater amount to the first outlet than to the second outlet;

a recycling branch with a first end connected with the first outlet and a second end connected with the input of the means for pumping; and means, coupled to the recycling branch, for controlling fluid flow in the recycling branch; and wherein the splitting device and the recycling branch deliver to the input of the means for pumping a multiphase fluid portion with a decreased GLR and the GLR of the output of the means for pumping is not modified between the output of the means for pumping and the input of the splitting device.

17. A pumping system according to claim 16, wherein:

the means for controlling flow rate includes a valve.

18. A pumping system according to claim 17, wherein:

the means for controlling flow rate includes a nozzle associated with the second end of the recycling branch.

19. A pumping system according to claim 17, wherein:

the means for controlling flow rate includes a regulator for regulating a recycled multiphase fluid portion depending on fluids provided from the fluid source.

20. A pumping system according to claim 16, wherein:

the means for controlling flow rate comprises a buffer tank interposed in the recycling branch.

21. A pumping system according to claim 20, wherein:

the means for controlling flow rate includes a nozzle associated with the second end of the recycling branch.

22. A pumping system according to claim 20, wherein:

the means for controlling flow rate includes a regulator for regulating a recycled multiphase fluid portion depending on fluids provided from the fluid source.

23. A pumping system according to claim 16, wherein:

the means for controlling flow rate includes a nozzle associated with the second end of the recycling branch.

24. A pumping system according to claim 16, wherein:

the means for controlling flow rate includes a regulator for regulating a recycled multiphase fluid portion depending on fluids provided from the fluid source.

25. A process for pumping a multiphase fluid including at least one liquid phase and at least one gas phase having a variable volumetric GLR of the at least one gas phase to the at least one liquid phase from a fluid source with a pressure increase through a line to a destination point comprising:

providing a multiphase pump with an input and an output, a splitting device having an inlet connected with the output of the multiphase pump, a first outlet and a second outlet connected with the line, a recycling branch with a first end connected with the first outlet of the splitting device and a second end connected with the input of the multiphase pump and a flow rate control coupled to the recycling branch;

pumping the multiphase fluid with a variable GLR with the multiphase pump;

distributing the liquid phase of the multiphase fluid with the splitting device in a greater amount to the first outlet of the splitting device than to the second outlet of the multiphase pump;

controlling fluid flow in the recycling branch with the flow rate control; and delivering to the input of the multiphase pump with the splitting element and the recycling branch a multiphase fluid portion with a decreased GLR with the GLR of the output of the multiphase pump not being modified between the output of the multiphase pump and the input of the splitting device.

26. A process in accordance with claim 25 wherein:

regulating a recycled multiphase portion depending on fluids provided from the fluid source.

27. A process in accordance with claim 26 wherein:

the splitting device is passive.

28. A process in accordance with claim 25 wherein:

the splitting device is passive.

* * * * *